US006176186B1

(12) United States Patent
Engel

(10) Patent No.: US 6,176,186 B1
(45) Date of Patent: Jan. 23, 2001

(54) SUBSONIC EXPANSION PROJECTILE

(75) Inventor: John W. Engel, Smithville, TX (US)

(73) Assignee: Engel Ballistic Research, Inc., Smithville, TX (US)

( * ) Notice: Under 35 U.S.C. 154(b), the term of this patent shall be extended for 0 days.

(21) Appl. No.: 09/327,863

(22) Filed: Jun. 8, 1999

(51) Int. Cl.[7] ..... F42B 12/34
(52) U.S. Cl. ..... 102/510; 102/506; 102/507
(58) Field of Search ..... 102/501, 507–510, 102/514–519, 506

(56) References Cited

U.S. PATENT DOCUMENTS

| | | | | |
|---|---|---|---|---|
| 914,992 | * | 3/1909 | Taylor | 102/510 |
| 1,063,748 | * | 6/1913 | Starkweather | 102/510 |
| 1,135,357 | * | 4/1915 | Clyne | 102/508 |
| 1,141,212 | * | 6/1915 | Ross | 102/510 |
| 1,833,645 | * | 11/1931 | Hartz | 102/510 |
| 3,348,486 | * | 10/1967 | Rapp | 102/507 |
| 4,550,662 | * | 11/1985 | Burczynski | 102/509 |
| 5,185,495 | * | 2/1993 | Petrovich et al. | 102/510 |

FOREIGN PATENT DOCUMENTS

| | | | | |
|---|---|---|---|---|
| 3840165 | * | 7/1990 | (DE) | 102/510 |
| 17152 | * | of 1899 | (GB) | 102/517 |
| 4426 | * | of 1899 | (GB) | 102/507 |
| 14717 | * | of 1900 | (GB) | 102/507 |

* cited by examiner

*Primary Examiner*—Harold J. Tudor
(74) *Attorney, Agent, or Firm*—Gunn, Lee & Keeling

(57) ABSTRACT

The present invention is directed toward an expansion projectile capable of achieving complete expansion at a subsonic speed. The projectile consists of a malleable core and a jacket of more structural integrity. Complete expansion is achieved through the use of a guaranteed misalignment of jacket scoring in relation to premade cuts within the projectile's core. Expansion is further facilitated through use of a gradient density bearing insert which is contained within the core. Upon impact of the projectile at its target the bearing insert will rupture and expand. This will guarantee complete disintegration of the projectile.

8 Claims, 4 Drawing Sheets

SUBSONIC EXPANSION PROJECTILE

BACKGROUND OF THE INVENTION

1. Field of the Invention

Applicant's invention relates to a projectile, and more specifically to a projectile of the expanding or mushrooming type. A method of manufacturing the projectile is also provided.

2. Background of the Prior Art

Generally expansion projectiles are comprised of a soft lead or other malleable core and surrounded by a more structurally sound metal jacket. The metal jacket is necessary to allow the projectile to withstand the heat of the explosion within a firearm upon its firing. The jacket will not generally cover the entire projectile core. In order to allow for expansion of the projectile upon impact, the nose of the projectile will not be covered by the jacket. Instead the nose will merely comprise the exposed soft lead core. This expansion projectile type is often referred to as the soft point expansion bullet.

Additional features of the soft point expansion bullet may include a hallowing out of the lead core near the nose or the addition of a dense or less malleable insert thereinto. These expansion projectile designs are disclosed and discussed in U.S. Pat. No. 2,838,000 to Schreiber for a "Projectile and Method of Making the Same" and U.S. Pat. No. 3,349,711 to Darigo, et. al. for a "Process of Forming Jacketed Projectiles".

Expansion projectiles are designed to deform significantly upon impact. Significant deformation of the projectile prevents its passage completely through targeted material. This maximizes the rapid lethality of the projectile. For example, wild game struck by a non-expanding projectile will generally survive a longer period of time and experience a less humane death than those struck by an expanding projectile capable of maximizing lethality due to its expansive action.

A second projectile type, the subsonic projectile, is desirable for military and police operations. In most basic designs, a projectile will exit a firearm at a speed greater than 1086 feet/sec. This supersonic speed provides the advantage of a maximum straight-line trajectory as well as reduced wind effects. However, there is a drawback to utilizing such projectiles in certain situations. Projectiles which achieve supersonic speeds generate an audible sound. This sound travels with the projectile along the course of its supersonic flight path. As a result, the origin of the projectile, the firearm, can be more readily traced and located. Obviously, there are occasions, during a military operation, for example, where traceability of the origin of the projectile would be disadvantageous to the firearms operator. As a result, subsonic ammunition has been developed. One means of obtaining subsonic ammunition speed is disclosed in U.S. Pat. No. 5,822,904 to Beal for "Subsonic Ammunition".

Unfortunately subsonic ammunition also has its disadvantages. Namely, subsonic ammunition cannot adequately deform upon impact as in the case of expansion projectiles. This is due to the relatively low speed at which the subsonic projectile travels. For example, in the case of the soft point bullet, the low speed of the subsonic projectile prevents adequate deformation with respect to the projectile's metal jacket casing. The soft point expansion bullet will complete its travel with deformation of its malleable nose and only partial expansion, if any, of its jacket.

In order to enhance jacket expansion the prior art reveals the use of jacket pleats or scoring as shown in U.S. Pat. Nos. 2,838,000 and 3,349,711. However, these features alone do not ensure jacket expansion of a subsonic projectile. The present invention overcomes inadequacies of the prior art and provides the first truly subsonic expansion projectile.

SUMMARY OF THE INVENTION

It is an object of the present invention to provide a jacketed expansion projectile.

It is another object of the present invention to provide a novel subsonic projectile.

It is yet another object of the present invention to provide a jacketed projectile utilizing a scored jacket allowing adequate jacket expansion.

It is another object of the present invention to provide an expandable projectile core utilizing separable petals at its nose.

It is yet another object of the present invention to provide a method of producing a subsonic expansion projectile.

It is another object of the present invention to provide an expansive bearing insert to aid jacket and core expansion of a projectile upon impact.

In satisfaction of these and related objectives, Applicant's present invention provides a new and improved subsonic expansion projectile and method of production therefor.

Other objects and advantages will be appreciated as they become better understood in light of the following description and drawings.

DETAILED DESCRIPTION OF THE PREFERRED EMBODIMENT

The projectile itself of the present invention is a part of a cartridge (not shown) intended to be used in conjunction with the firing of a firearm. In addition to the projectile, the cartridge would consist of general features such as a subsonic shell, a charge, and others. The focus of the present invention is on a particular projectile, a subsonic expansion projectile, which leaves the rest of the cartridge behind and eventually strikes a target following the firing of a firearm with the cartridge therein.

Figure 1:
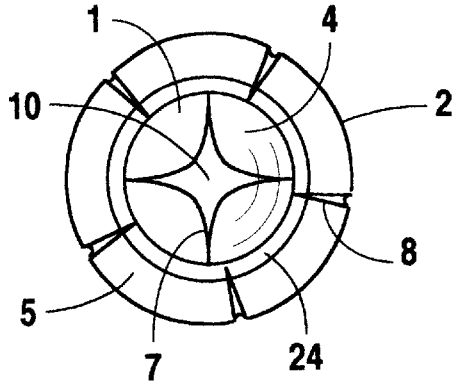
FIG. 1 is a front view of the completed projectile.
Figure 2:
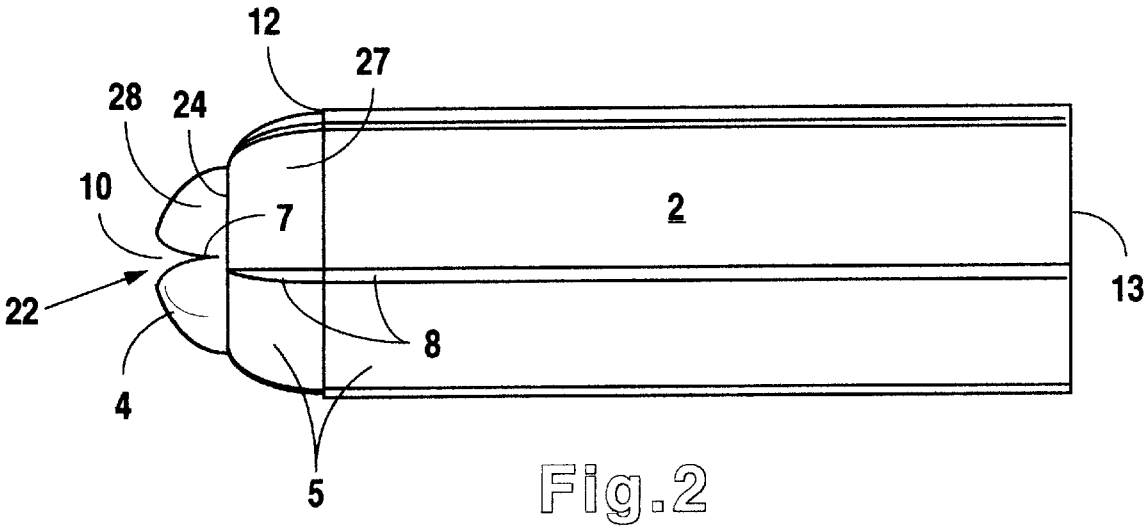
FIG. 2 is a side view of the completed projectile.

Referring to FIGS. 1 and 2, front and side views of the subsonic expansion projectile are shown respectively. The projectile is comprised of a core (1) which rests within a jacket (2) casing. The core (1) is made from a soft malleable metal, generally lead. In order to give the projectile structural integrity the core (1) is surrounded by a jacket (2) of a more rigid metal such as a copper alloy. For purposes of this application, applicant defines the work "integrity " as strength. The jacket (2) is closed at its base (13) to contain the core (1) and maintain projectile integrity upon the projectiles firing from a firearm. However, the jacket (2) is open at rim (24) at the top of the projectile is exposing its core (1). The top of the projectile consists of a nose (22) within which a core depression (10) has been created. Exposure of the core (1) and the core depression (10) promote mushrooming or expansion activity, described in more detail herein.

The core (1) is divided at an ogive core portion (28) of the nose (22) into four equisized core petals (4) by four equispaced core cuts (7). Correspondingly, the jacket (2) is divided throughout, with the exception of its base (13), into five equisized jacket petals (5) by five equispaced jacket scores (8). The jacket scores (8) are depressions in the jacket surface. They originate at the rim (24), run across an give jacket portion (27), continue over an give ridge (12) and run the length of the projectile terminating at the jacket base (13). This provides jacket petals (5) terminating at the jacket base (13). The present invention does not require that the core petals (4) and core cuts (7) always exist in an abundance of four. Likewise, jacket petals (5) and jacket scores (8) need not always exist in abundance of five. However, it is required that the jacket scores (8) be equispaced from one another, that the core cuts (7) be equispaced from one another, that the core petal petals (4) be equisized in relation to one another, that the jacket petals (5) be equisized in relation to one another and that the jacket petals (5) and core petals (4) differ in amount. Preferably there will be an even number of core petals (4) and an odd number of jacket petals (5) or vice versa. A particularly successful embodiment of the present invention is that described herein utilizing four core petals (4) in relation to five jacket petals (5). However, this particular ratio of four core petals (4) to five jacket petals (5) is not essential.

One of the main features of the present invention is that utilizing a different number of core petals (4) in relation to jacket petals (5) ensures that jacket scores (8) cannot all be aligned with core cuts (7) simultaneously, nor to the same degree. The importance of this intentional guaranteed misalignment will be explained further herein.

Figure 3A:
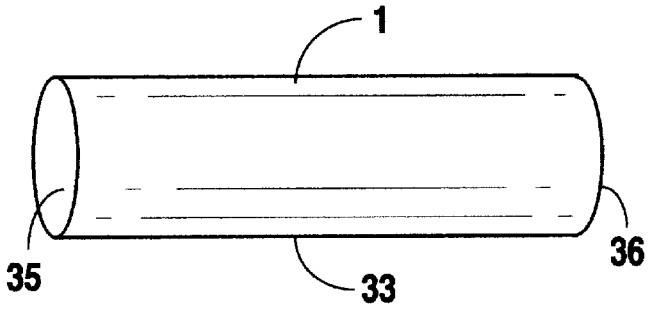
FIG. 3*a* is a side view of the projectile's lead core prior to manufacture.
Figure 3B:
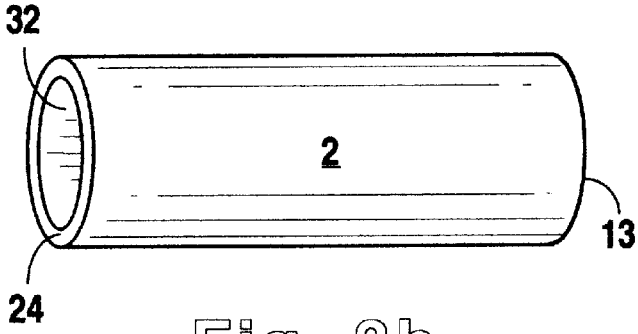
FIG. 3*b* is a side view of the projectile jacket prior to manufacture of the projectile.

Referring to FIGS. 3*a* through 3*d*, the component parts of the present invention are shown. The core (1) of FIG. 3*a* is comprised of lead which has been cut from a lead wire of the desired thickness. The initially cut core (1) will have a core head (35) a core base (36) and a core surface wall (33). Meanwhile, the jacket (2) of FIG. 3*b* comprises a corresponding jacket side wall (32), the base (13), and the rim (24) previously mentioned. The jacket (2) diameter will be chosen to correspond with the core's (1) thickness.

Figure 3C:
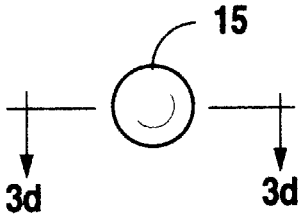
FIG. 3*c* is a perspective view of a bearing insert prior to its use as a component of the projectile.
Figure 3D:
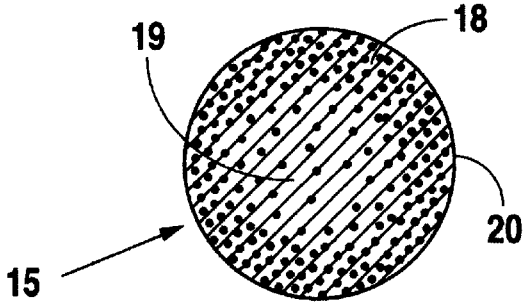
FIG. 3*d* is an enlarged cross sectional view of the bearing insert of FIG. 3*c* taken along section lines 3*d*—3*d* prior to its use as a component of the projectile.

Referring specifically to FIGS. 3*c* and 3*d* a bearing insert (15) is shown. The bearing insert (15) may be comprised of any significantly solid material, generally one, such as stainless steel or high grade plastic, having a more integrity than that of the malleable core (1). Referring more specifically to FIG. 3*d* a cross section of a bearing insert (15) of gradient density is shown. The bearing insert (15) is formed from a slow drying substance such as silicone. A substance such as silicone may dry in the shape of a bearing insert (15) with a solid casing surface (20), a dense portion (18) just below this surface (20), and a low density center (19) which may remain fluid. A gradient density bearing insert (15) further aids in the expansive action of the projectile upon impact as will be discussed herein.

Figure 4A:
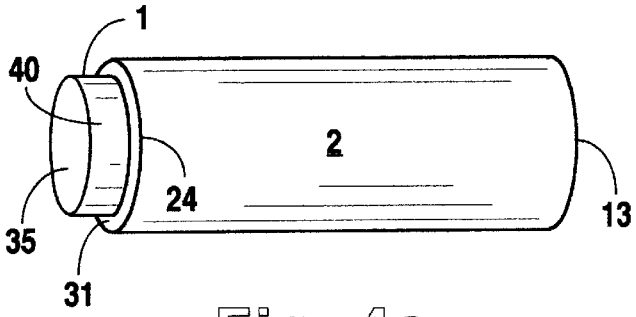
FIG. 4*a* is a perspective view of the lead core and jacket of the present invention during manufacture of the projectile.

Referring to FIGS. 4*a* through, 4*c* a method of manufacturing a subsonic expansion projectile is shown. As shown in FIG. 4*a*, the individual core (1) of FIG. 3*a* is placed within the individual jacket (2) of FIG. 3*b*. Usually the placement of the core (1) within the jacket (20) will be a loose fit. A loose fit allows for the application of a liquid flux (not shown). The liquid flux is dropped into the jacket (2) at its rim (24) with the core (1) therein. Heat is applied to the jacket (2) and a permanent contact (31) is formed between the core (1) and the jacket (2) (See FIG. 5). The contact (31) is a molecular bond between the core surface wall (33) and the jacket side wall (32). The contact (31) may also exist between the core base (36) and a corresponding portion of the jacket (2) opposite the jacket base (13). The core head (35) extends out beyond the rim (24) of the jacket in the form of the a core extension (40) which is the precursor to the ogive core (28) and core petals (4).

Figure 4B:
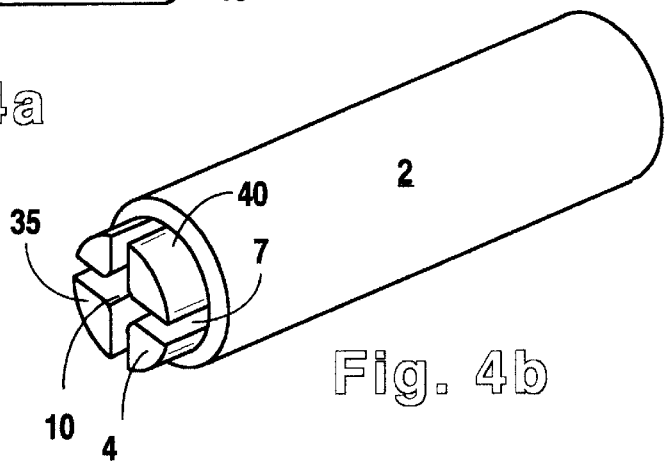
FIG. 4*b* is a perspective view of the lead core and jacket of the present invention following a nose punch application.

Referring to FIG. 4*b* the projectile is shown following application of a nose punch. The nose punch application swages out the core depression (10) and the core cuts (7) to a point below the core extension (40). The application is directed at the core head (35) while the jacket (2) is secured. The contact (31) acts to retain the core (1) within the jacket (2) during this application. At this point the core petals (4) appear in a precursory form.

Figure 4C:
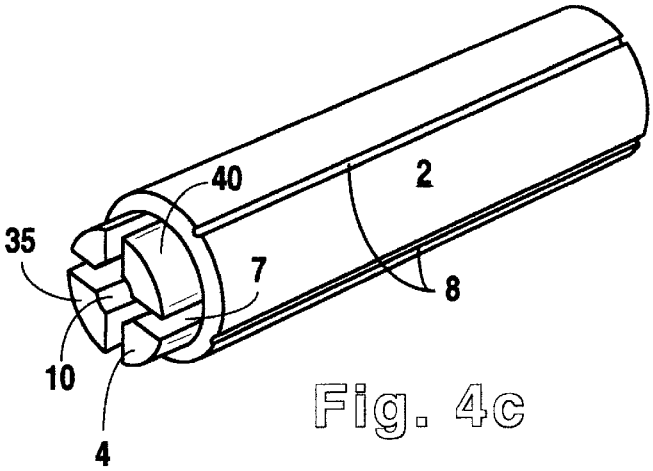
FIG. 4*c* is a perspective view of the lead core and jacket of the present invention following nose punch and jacket scoring applications.
Figure 4D:
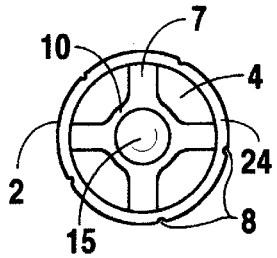
FIG. 4*d* is a front view of the lead core and jacket of the present invention following nose punch and jacket scoring applications with insertion of a bearing insert.
Figure 4E:
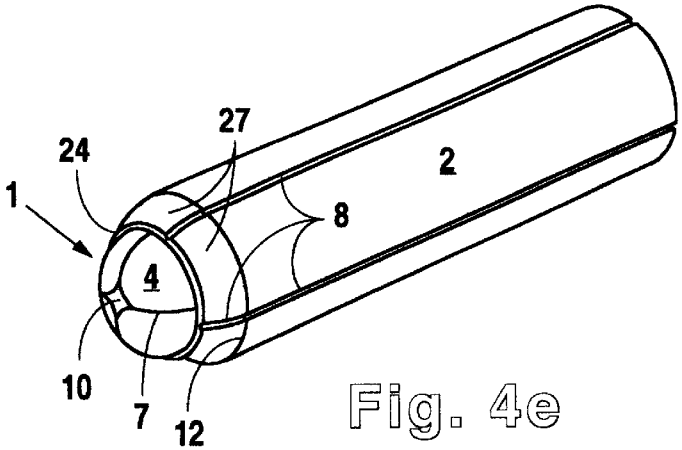
FIG. 4*e* is a perspective view of the completed projectile following ogive nose formation.

Referring to FIGS. 4*c* and 4*d*, two more novel features of the present invention are revealed. First, five equidistant scores (8) are added to the jacket (2). Second, as shown in FIG. 4*d*, a gradient density bearing insert (15) is placed within the core depression (10).

As stated earlier, there is a guaranteed misalignment of jacket scoring (8) and core cuts (7). As a result there will always be one jacket score (8) which is closer to the center of a core petal (4), and likewise further from any core cut (7), than any other. This particular jacket score (8) will be the weakest portion of the jacket (2) upon impact of a projectile at its target. In fact, the weakness of this score (8) will be sufficient to allow complete expansion to proceed even at subsonic speeds. Without this weakest score (8) random strengthening of the scores (8) will occur due to all scores (8) facing the same amount of stress from expanding core petals (4).

In addition to this intentional misalignment of scores, a bearing insert (15) has been placed within the core depression. A bearing insert (15) has the effect of being forced within the core (1) upon impact of the projectile at a target, thereby furthering the projectile's expansive nature. The bearing insert (15) of the present invention has the added effect of being gradient in density with a low density center (19) (see FIG. 3*d*). Alternatively, the gradient density bearing insert may consist of a center having less structural integrity and being more malleable than the bearing's surface without necessarily having the densities disclosed by comparison here. The key to the gradient density bearing insert being its ability to rupture and expand rather than its actual composition or varying densities. The bearing insert (15) of the present invention is expansive of its own nature upon impact. Thus, when a projectile hits its target the bearing insert (15) is not only pushed within the core (1) to further core (1) and jacket (2) expansion, but the bearing insert (15) itself expands, which results in an expansive effect beyond that of a uniform density bearing insert.

Referring, to FIG. 4*c* a perspective view of the completed subsonic expansion projectile is shown. The features of FIGS. 1 and 2 are apparent here. Additionally, the depth of the core depression (10) is more apparent. A core depression (10) of significant volume results in more independent core petals (4). The ogive nose (22) is formed by application of a concave nose punch (not shown) to the front end of the bonded core (1) and jacket (2). There is no requirement that the ogive nose (22) actually be of any particular curvature or design with respect to its shape.

Figure 5:
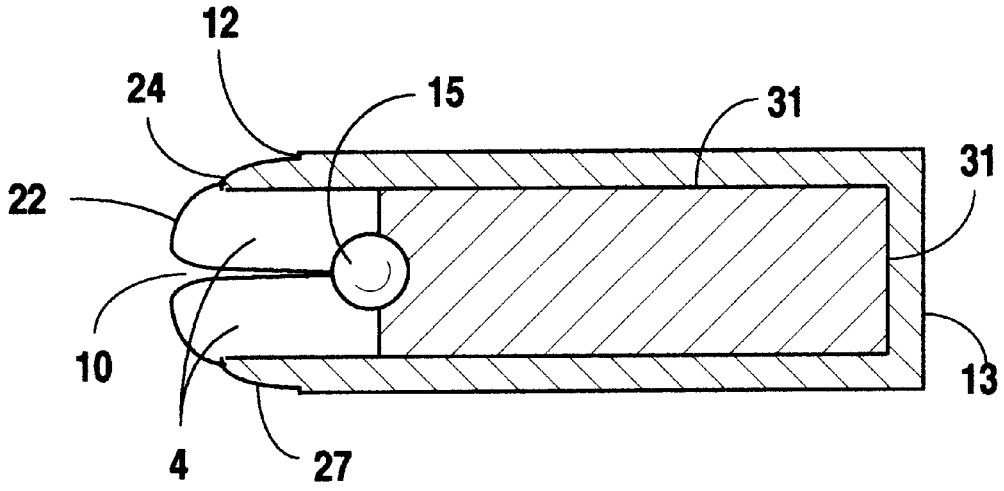
FIG. 5 is a side cross sectional view of the projectile shown in FIG. 4*e*.
Figure 6:
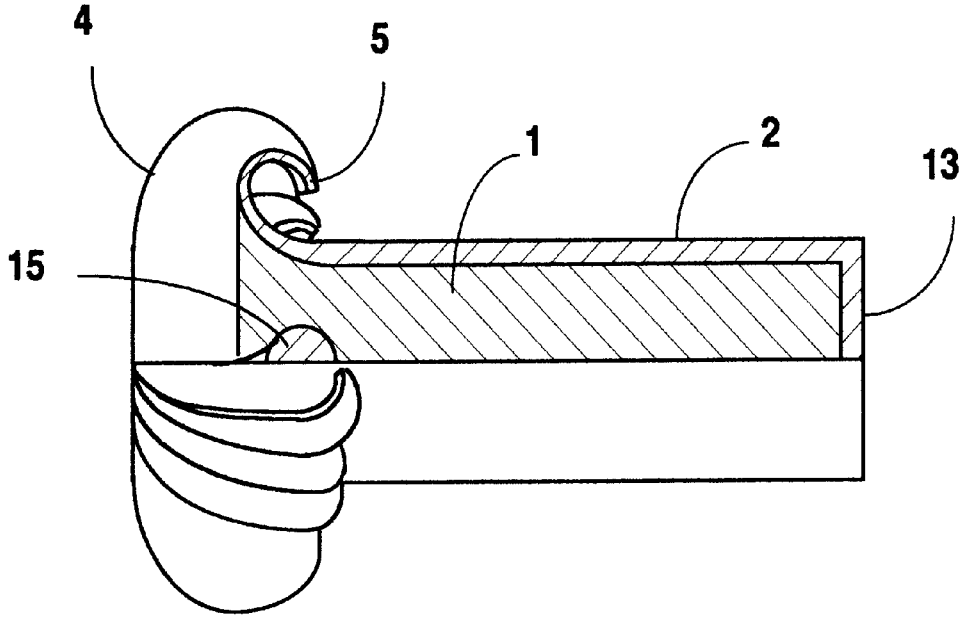
FIG. 6 is a partial cross sectional view of the projectile during expansion.

Referring to FIGS. 5 and 6 the expansive action of the projectile becomes more apparent. Referring specifically to FIG. 5 the nose (22) of the projectile will first come into contact with a target. The nose (22) being entirely malleable and divided into core petals (4) will immediately begin to expand and place pressure on the jacket rim (24) and the ogive ridge (12) of the ogive jacket (27). Due to the intentional misalignment of core cuts (7) and jacket scores (8), this pressure will be sufficient to result in complete expansion of the jacket (2) beginning at the weakest score (8). Complete expansion will result even where the projectile hits its target at subsonic speeds. In addition to this pressure at the ogive jacket (27), the deforming core (1) will begin to apply extreme pressure to the bearing insert (15). In turn, the bearing insert (15) will begin to deform the core (1) further internally toward the base (13). Additionally, as the pressure on the bearing insert (15) increases its solid casing (20) will rupture and the bearing insert (15) will explode toward the jacket side walls (32) due to its gradient density composition. The explosion of the bearing insert (15) guarantees the complete expansion of the projectile even where impact occurs at subsonic speeds.

Referring specifically to FIG. 6 we can see the expansion of the projectile during impact. As the nose (22) of the projectile strikes its target, it deforms due to its soft lead composition. The core petals (4) act on the jacket petals (5) which begin to disintegrate in unison in a pealing motion toward the base (13). The bearing insert (15) is shown being compressed into the core (1) just prior to its own expansion.

The bearing insert (15) will later expand due to its own malleable or less dense center (19) and guarantee complete disintegration of the projectile. While the bearing insert (15) guarantees complete disintegration of the projectile, it is not essential. Either the guaranteed misalignment of the core cuts (7) and the jacket scores (8) or the bearing insert (15) described here would be sufficient to cause complete expansion and disintegration of the projectile.

Although the invention has been described with reference to a particular range of embodiments and methods, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A subsonic expansion projectile intended for firing from a firearm comprising:

a longitudinal malleable core having an exposed forward end and an enclosed rearward end, said exposed forward end further comprising core cuts running from said exposed forward end and extending longitudinally toward said enclosed rearward end, said longitudinal malleable core further comprising core petals between said core cuts; and a cylindrical jacket casing surrounding said longitudinal malleable core and having an upper end and a lower end, said cylindrical jacket casing having an opening at said upper end whereby said longitudinal malleable core is exposed at said exposed forward end, said cylindrical jacket casing further comprising scores which run from said upper end at said opening longitudinally toward said lower end, said cylindrical jacket casing further comprising jacket petals between said jacket scores, said jacket scores and said core cuts being misaligned, said cylindrical jacket casing and said longitudinal malleable core form said subsonic expansion projectile for firing from said firearm, said subsonic expansion projectile being expansive beginning with a separation of said core petals from one another upon initial impact of said subsonic expansion projectile with a target, said subsonic expansion projectile having further expansion with separation of said jacket petals from one another as impact completes until entire disintegration of said subsonic expansion projectile has occurred.

2. The subsonic expansion projectile intended for firing from said firearm of claim 1 wherein said scores and said core cuts differ in number, said scores being the same in number as said jacket petals and said core cuts being the same in number as said core petals.

3. The subsonic expansion projectile intended for firing from said firearm of claim 2 wherein said scores are odd in number and said core cuts are even in number.

4. The subsonic expansion projectile intended for firing from said firearm of claim 2 wherein said scores are of a number one greater than said core cuts.

5. The subsonic expansion projectile intended for firing from said firearm of claim 2 wherein said scores are even in number and said core cuts are odd in number.

6. The subsonic expansion projectile intended for firing from said firearm of claim 2 wherein said core cuts are of a number one greater than said scores.

7. The subsonic expansion projectile intended for firing from said firearm of claim 2 wherein said scores number five and said core cuts number four.

8. A subsonic expansion projectile intended for firing from a firearm comprising:

a longitudinal malleable core having a first end, a second end, and a cavity disposed within said longitudinal malleable core between said first end and said second end;

a cylindrical jacket casing surrounding said longitudinal malleable core, said casing having a forward end and a rearward end, said rearward end being closed and said forward end being open and exposing said longitudinal malleable core;

a gradient density bearing insert contained within said malleable core at said cavity, said gradient density bearing insert having an inner portion and an outer portion, said outer portion having a higher integrity than said inner portion and said gradient density bearing being formed from a substance that is solid at its surface, but fluid at its center, said substance comprising silicone; and a projectile nose portion of said subsonic expansion projectile consisting of said first end of said longitudinal malleable core and said forward end of said cylindrical jacket casing;

said cylindrical jacket casing and said longitudinal malleable core constitute said subsonic expansion projectile capable of withstanding firing from said firearm, said subsonic expansion projectile being expansive beginning with deformation of said projectile nose portion during initial impact which in turn causes deformation of said cavity and said gradient density bearing insert therein, said subsonic expansion projectile further expanding and ultimately entirely disintegrating during completion of impact as a result of rupturing of said gradient density bearing insert following said deformation thereof.

* * * * *